US007302891B1

(12) United States Patent
Adams

(10) Patent No.: US 7,302,891 B1
(45) Date of Patent: Dec. 4, 2007

(54) FIREARM PROJECTILE WITH ENHANCED AERODYNAMIC PROPERTIES

(76) Inventor: John Q. Adams, 3385 John Adams Rd., Willow Springs, NC (US) 27592

( * ) Notice: Subject to any disclaimer, the term of this patent is extended or adjusted under 35 U.S.C. 154(b) by 122 days.

(21) Appl. No.: 10/891,640

(22) Filed: Jul. 15, 2004

(51) Int. Cl.
*F42B 10/00* (2006.01)

(52) U.S. Cl. ..... 102/514; 102/439

(58) Field of Classification Search ..... 102/439, 102/464, 469, 470, 471, 514, 515, 516, 524, 102/525, 526, 527, 528, 501; D22/126, 116, D22/100, 115, 199
See application file for complete search history.

(56) References Cited

U.S. PATENT DOCUMENTS 2,234,165 A * 3/1941 Hatcher et al. ..... 102/526
4,610,205 A * 9/1986 Bentley ..... 102/529
5,058,503 A 10/1991 Adams
5,443,010 A * 8/1995 Dahlitz ..... 102/511

* cited by examiner

*Primary Examiner*—T. Nguyen
(74) *Attorney, Agent, or Firm*—Coats & Bennett PLLC

(57) ABSTRACT

A firearm projectile includes a central section, a forward or leading section, and a rear or trailing section. A step down is provided between the central section and the trailing section such that the cross sectional area of the trailing section is less than the cross sectional area of the central section. In addition the trailing section is provided with a cavity that is open about the back of the trailing section. The cavity includes a forward section and rearward section. Forming the part of the forward section is a forward wall that terminates in the trailing section short of the central section. The rearward section of the cavity flares outwardly with respect to the forward section. Furthermore the rearward portion of the rearward section of the cavity forms a part of an annular flare ring that extends around the outer portion of the back of the trailing section.

19 Claims, 3 Drawing Sheets

FIREARM PROJECTILE WITH ENHANCED AERODYNAMIC PROPERTIES

FIELD OF THE INVENTION

The present invention relates to projectiles of the type fired from firearms, and more particularly to a projectile that includes a specially contoured trailing section that is designed to enhance the aerodynamic properties of the projectile.

BACKGROUND OF THE INVENTION

U.S. Pat. No. 5,058,503 issued to the present inventor relates to an aerodynamic projectile having a central section, a leading section and a trailing section. Formed in the trailing section is a cavity that extends from the back of the projectile forwardly to where the cavity terminates in an area of the central section. When the projectile is fired, the exploding gases enter the cavity and because of the pressures that exist within the cavity, expansion is said to occur. Because the cavity extends substantially forwardly to where a portion of the cavity extends into the central section, the expansion that takes place in the cavity exerts an outer force and causes portions of the outer surface or jacket of the central section to frictionally engage the barrel of a firearm. It is believed that this is problematic and detracts from the performance, accuracy and general efficiency of the firearm and the projectile being fired. Indeed this expansion and resulting frictional engagement causes a build up of material in the barrel. This build up is difficult to clean and if permitted to accumulate over time, can only contribute to poor performance in a firearm.

Further, the geometry of the projectile shown in U.S. Pat. No. 5,058,503 and the design of the cavity certainly made the projectile aerodynamically superior to many projectiles of prior art. However, it is believed that the design of the cavity can be further improved to enhance the aerodynamic properties of the projectile.

SUMMARY OF THE INVENTION

The present invention entails a projectile having a cylindrical central section with an outer surface. A leading section is integrally formed with the central section and projects forwardly therefrom. A trailing section is integrally formed with a central section and projects rearwardly therefrom and the trailing section includes a surrounding outer surface having a rearward portion and a back. A cavity is formed in the trailing section and extends from the back towards the forward portion of the trailing section. The cavity includes a forward center section having a forward wall that terminates in the trailing section short of the central section. The cavity further includes a rearward section that extends rearwardly from the forward section with the rearward section including a wall structure having a rearward end portion. An annular flare ring is formed about the rear of the trailing section and includes a rearwardly facing rounded nose that blends with the rearward end portion of the wall structure of the rearward section and blends with a portion of the surrounding outer surface of the trailing section.

In another embodiment the firearm projectile comprises a cylindrical central section having an outer surface and a leading section integrally formed with the central section and projecting forwardly therefrom. A trailing section is provided and is integrally formed with the central section and includes an outer surface and a back wherein the trailing section projects rearwardly from the central section. A cavity is formed in the trailing section. There is provided a step-down between the central section and the trailing section such that the cross-sectional area of the trailing section adjacent the step-down is less than the cross-sectional area of the central section adjacent the step-down. The outer surface of the central section and the outer surface of the trailing section adjacent the step-down extend in general parallel relationship.

Other objects and advantages of the present invention will become apparent and obvious from a study of the following description and the accompanying drawings which are merely illustrative of such invention.

DESCRIPTION OF THE INVENTION

With further reference to the drawings, the projectile of the present invention is shown therein and indicated generally by the numeral 10. Projectile 10 is a firearm projectile and is designed to be inserted into a loaded cartridge for firing from a firearm.

Figure 2:
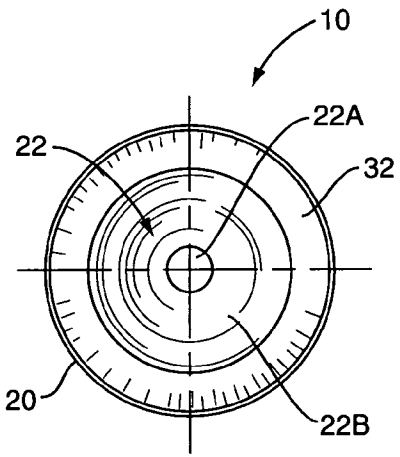
FIG. 2 is an end elevational view showing the trailing section of the projectile.
Figure 1:
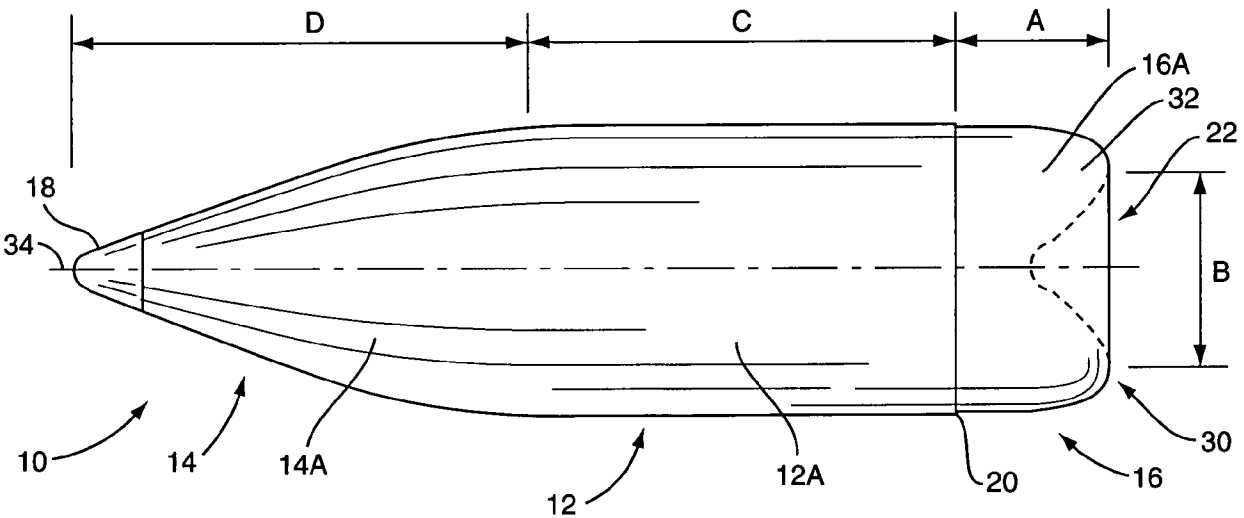
FIG. 1 is a side elevational view of the projectile of the present invention.

Viewing projectile 10 in more detail, the same includes a central section indicated generally by the numeral 12, a leading section indicated generally by the numeral 14 and a trailing section indicated generally by the numeral 16. Viewing central section 12 first, the central section assumes a generally cylindrical configuration. As illustrated in FIG. 1, the central section 12 in the embodiment illustrated in the drawings extends a length indicated by C. Further, central section 12 is of a generally constant diameter and includes an outer surface 12A.

Projecting forwardly from the central section 12 is the leading section 14. Leading section 14 includes a tapered portion that extends downwardly to a point 18. In the embodiment illustrated herein, the leading section 14 includes a length designated by D. See FIG. 1.

For purposes of reference, projectile 10 is said to include a central section 12 and a leading section 14. However, it should be pointed out that there is no precise or particular point where the projectile transforms from the central section 12 to the leading section 14. This area or point of transformation can vary. In many embodiments, the demarcation between the central section 12 and the leading section 14 will be is where the diameter of the central section starts to decrease significantly, such as shown in FIG. 1.

Turning to the trailing section 16, the trailing section includes an outer surface 16A. There's also provided a step-down 20 formed between the central section 12 and the trailing section 16. Note that the trailing section 16 from the step down 20 to the back or the rear side of the trailing section includes a diameter that is generally less than the diameter of the central section 12. In addition, it is noteworthy that the outer surfaces 12A and 16A adjacent the step-down 20 extend generally in parallel relationship. That is, from the step-down 20 towards the rear or back of the trailing section 16, it can be said that for a significant length from the step-down that the outer surface 16A of the trailing section is parallel with the adjacent outer surface 12A of the central section. As will be discussed subsequently herein, the rear portion of the trailing section 16 will slightly curve to form a part of the back structure of the trailing section. As indicated in FIG. 1, the length of the trailing section 16 is represented by A.

Formed in the trailing section 16 is a cavity indicated generally by the numeral 22. Note that cavity 22 is open from the back of the projectile and that the cavity projects forwardly from the back of the trailing section 16 to a forward point in the trailing section. In particular, for purposes of reference, cavity 22 includes a forward cavity section 22A and a rearward cavity section 22B. See FIG. 3. Viewing forward cavity section 22A, it is seen that the same includes a terminal or forward wall 24. Extending around the forward cavity section 22A is a sidewall 26. Note that the forward wall 24 terminates in the trailing section 16 and does not extend into the central section 12.

Now viewing the rearward cavity section 22B, the same includes a wall structure 28. Wall structure 28 extends from the forward cavity section 22A rearwardly to an area that generally coincides with the back or rearward portion of the trailing section 16. The shape and configuration of the forward cavity section 22A and the rearward cavity section 22B can vary. However, in the case of the embodiment illustrated in the drawings, the wall structure 28 that forms a part of the rearward cavity section 22B is generally arcuate and forms a slightly convex shape. This is particularly illustrated in FIGS. 3 and 4.

Formed about the outer rear portion of the trailing section 16 is a flare ring indicated generally by the numeral 30. Flare ring 30 includes a surrounding annular nose 32. Note that the nose includes a face that faces rearwardly. This rearwardly facing nose is arced or rounded as opposed to forming a rearward point about the backside of the trailing section 16.

Flare ring 30 is formed in part by the rearward cavity section 22B and the outer surface 16A of the trailing section 16. More particularly, outer surface 16A includes a rearward portion that extends around the trailing section and this rearward portion tends to curve slightly inwardly to form a portion of the surface of the flare ring 30. Similarly, the outer or rearward most portions of the wall structure 28 that forms a part of the rearward cavity section 22B also plays a role in forming the flare ring. In this case, note how the rearward or outer portions of the wall structure 28 tend to curve to form a portion of the flare ring 30.

Figure 4:
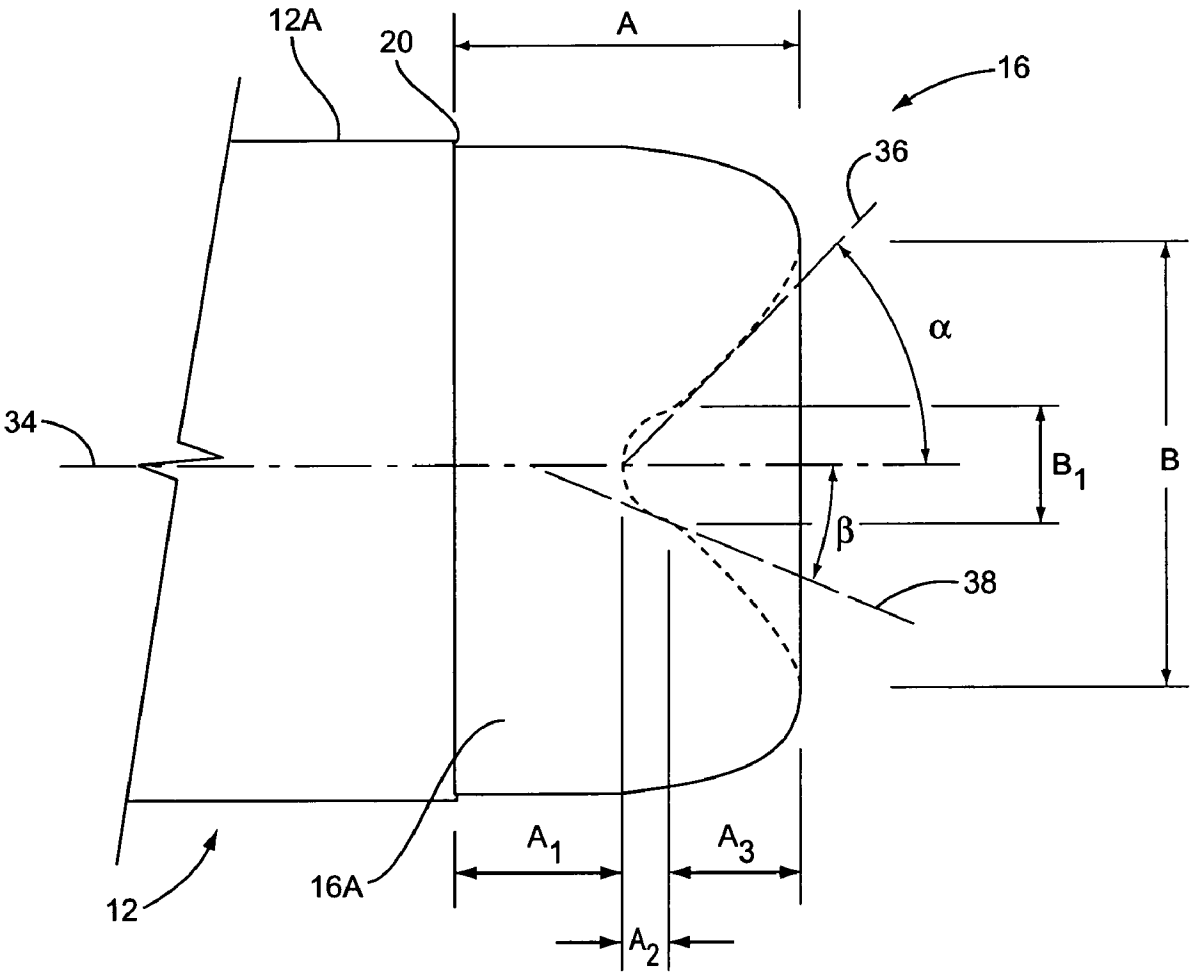
FIG. 4 is a diagrammatic illustration of the cavity formed in the trailing section of the projectile and pointing out a number of dimensional and angular relationships concerning the structure and configuration of the cavity.

FIG. 4 is provided for the purpose of illustrating some general dimensional and angular relationships with respect to various components of the cavity 22 and the trailing section 16. Note again that the length of the trailing section is referred to by A. The dimension $A_1$ indicates the distance between the step-down 20 and the forward wall 24 of the forward cavity section 22A. $A_2$ represents the depth or length of the forward cavity section of 22A. That is, $A_2$ represents the length generally between the forward wall 24 and the point where the cavity 22 transforms from the forward cavity section 22A to the rearward cavity section 22B. $A_3$ generally represents the depth of the rearward cavity section 22B. That is, $A_3$ represents the length or depth between where the rearward cavity section 22B starts and the back of the trailing section 16.

Continuing to refer to FIG. 4, $B_1$ represents the diameter of the forward cavity section 22A. B represents the maximum diameter of the rearward cavity section 22B. Note that the maximum diameter of the rearward cavity section 22B is approximately three times the diameter ($B_1$) of the forward cavity section 22A.

Still referring to FIG. 4, there is shown a number of construction lines that assist in describing or illustrating the structural relationships of various parts of the cavity 22. First, the projectile is said to have a major axis that is indicated by the numeral 34. Next there is provided a tangent/construction line 36 and another tangent/construction line 38. First with respect to construction line, 36 the same is drawn generally tangential to the midpoint of the concave convex arc that forms a part of the wall structure 28. Construction line 38 is drawn generally tangential to a portion of the sidewall 26 that forms a part of the forward cavity section 22A. Note angle $\alpha$, which extends between the major axis 34 and the construction line 36. In the embodiment illustrated herein angle $\alpha$ is approximately 45°. However, angle $\alpha$ can vary and in some embodiments may range from approximately 35° to 55°. Likewise in the embodiment illustrated herein, angle $\beta$, illustrated in FIG. 4, is approximately 23°. Angle $\beta$, like angle alpha, can vary and in some embodiments angle $\alpha$ can vary from approximately 10° to 36°.

Because of the step-down 20, the outer surface 16A of the trailing section 16 is said to be a generally non-bearing surface. That is, with the slight reduction in diameter, the outer surface 16A of the trailing section would not ordinarily bear against the wall of the firearm barrel. In a preferred embodiment, the outer surface 16A would not be provided with conventional rifling grooves that are typically found on the outer surfaces of projectiles that bear against the inner wall of the barrel. Instead, the outer surface 16A of this rear section would be smooth. In many cases, the outer surface 12A of the central section 12 would bear against the wall of the barrel. Further, note that the cavity 22 is confined to the trailing section 16 of the firearm. Thus, if there is any substantial expansion in response to the firing of the projectile within a firearm, then the outer surface 16A is less likely to be forced against the wall of the barrel. Thus, deposits resulting from the frictional engagement of the outer surface of the firearm are believed to be minimized due to the location of the cavity 22.

Further, it is hypothesized that as a projectile flies towards its target, that air passing over the projectile tends, in conventional designs, to create a vacuum about the back of the projectile. In the case of the present invention, the design of the trailing section 16 and the cavity 22 is such that it is hypothesized that air flowing past the projectile will curl and move into the area immediately adjacent the back of the projectile 10 which tends to eliminate or minimize the potential for a vacuum existing in this area. As noted above, the outer surface 16A of the trailing section 16 is smooth and does not include engraved rifling grooves. It is believed that the smooth surface 16A contributes to the aerodynamic properties of the projectile in that air is permitted to pass thereover without interference from rifling grooves. This, it is hypothesized, that the design of the cavity 22 increases the aerodynamic properties of the projectile 10 as a whole and makes the projectile more accurate and efficient and tends to increase the projectile's velocity especially as the projectile approaches the target.

Figure 3:
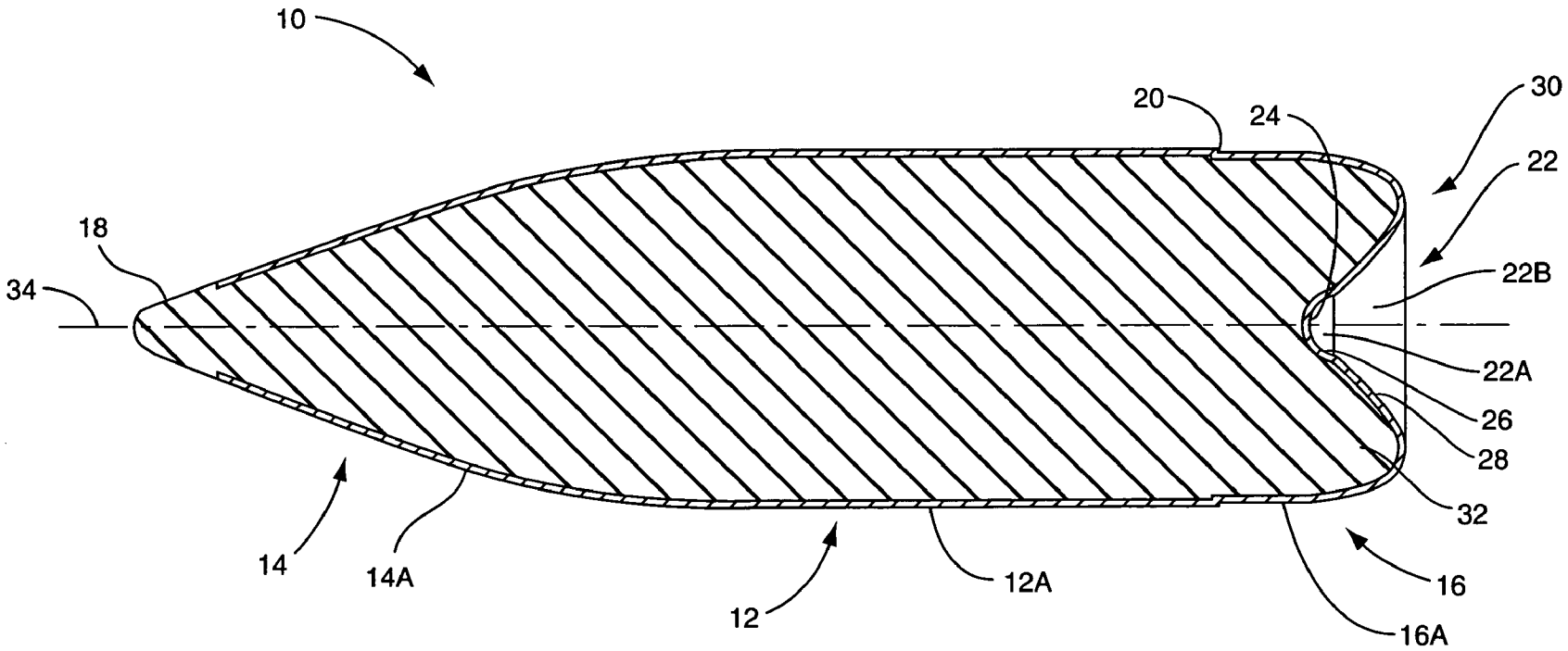
FIG. 3 is a longitudinal sectional view of the projectile.

As indicated in FIG. 3, the projectile 10, in the embodiment illustrated, includes an outer jacket. Typically, projectiles can be manufactured by selecting an outer jacket that would be made of a zinc or copper alloy, for example. In the manufacturing process, the jacket is filled with lead, for example, and thereafter the composite is shaped by a machine or a machine tool. Other approaches to manufacturing may be used.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A firearm projectile comprising:

a. a cylindrical central section having an outer surface;

b. a leading section integrally formed with the central section and projecting forwardly therefrom, the leading section having a forward pointed outer tapered surface;

c. a trailing section integrally formed with the central section and projecting rearwardly therefrom, the trailing section including a surrounding outer surface having a rearward portion, and a back;

d. a cavity formed in the trailing section and extending from the back towards a forward portion of the trailing section;

e. the cavity including a forward section having a forward wall that terminates in the trailing section short of the central section;

f. the cavity further including a rearward section that extends rearwardly from the forward section, the rearward section including a wall structure having a rearward end portion;

g. an annular flare ring forming a part of the trailing section that blends with the rearward end portion of the wall structure of the rearward section and blends with the rearward end portion of the surrounding outer surfaces of the trailing section; and h. the annular flare ring including a rounded nose that forms an extreme rear portion of the projectile and wherein the rounded nose extends circumferentially around the cavity and wherein the entire rear portion of the nose is substantially rounded about substantially the entire area of the annular flare ring.

2. The projectile of claim 1 wherein the cavity includes a depth that is equal to or less than the width of the cavity.

3. The projectile of claim 1 wherein there is a step down formed in the projectile between the central section and trailing section.

4. The projectile of claim 3 wherein the outer surface of the central section and the outer surface of the trailing section extend in general parallel relationship for a substantial distance on both sides of the step down.

5. The projectile of claim 1 wherein both the central section and the trailing section are cylindrically shaped and wherein the minimum cross sectional area of the trailing section is less than the maximum cross sectional area of the central section.

6. The projectile of claim 1 wherein the depth of the rearward section of the cavity is greater than the depth of the forward section of the cavity.

7. The projectile of claim 1 wherein the wall structure of the rearward section of the cavity is concave.

8. The projectile of claim 7 wherein the projectile includes a major axis and for reference purposes a reference line that extends generally tangential to a midpoint of the concave wall of the rearward section of the cavity forms an angle $\alpha$ between the major axis and wherein the angle $\alpha$ is approximately 35-55°.

9. The projectile of claim 8 wherein angle $\alpha$ is approximately 45°.

10. The projectile of claim 1 wherein the width of the rearward section of the cavity is at least two times the width of the forward section of the cavity.

11. The firearm projectile of claim 1 wherein the outer surface of the trailing section is smooth and does not include rifling grooves.

12. A firearm projectile comprising:

a. a cylindrical central section having an outer surface;

b. a leading section integrally formed with the central section and projecting forwardly therefrom;

c. a trailing section integrally formed with said central section and including an outer surface and a back, and wherein the trailing section projects rearwardly from the central section;

d. a cavity formed in the trailing section;

e. a step down formed in the projectile between the central section and the trailing section such that the cross sectional area of the trailing section adjacent the step down is less than the cross sectional area of the central section adjacent the step down;

f. wherein the outer surface of the central section and the outer surface of the trailing section adjacent the step down extend in general parallel relationship;

g. an annular flare ring formed on the back of the trailing section that blends into the outer surface of the trailing section and the cavity; and h. the annular flare ring including a rounded nose that forms an extreme rear portion of the projectile, and wherein the rounded nose extends circumferentially around the cavity and wherein the extreme rear portion of the nose is substantially rounded about substantially the entire area of the annular flare ring.

13. The projectile of claim 12 where the outer surface of the trailing section extends rearwardly to the flare ring and a rearward portion of the outer surface of the trailing section curves into and forms a part of the flare ring.

14. The projectile of claim 12 wherein both the central section and the trailing section are cylindrically shaped and wherein the maximum cross sectional area of the trailing section is less than the minimum cross sectional area of the central section.

15. The projectile of claim 12 wherein the cavity includes a forward center section having a forward wall that terminates in the trailing section short of the central section.

16. The firearm of claim 15 wherein the cavity further includes a rearward section that extends rearwardly from the forward section, the rearward section including a concave shaped wall structure.

17. The projectile of claim 16 wherein the projectile includes a major axis and for reference a reference line extending generally tangential to a midpoint of the concave wall forms an angle $\alpha$ with the major axis and wherein angle $\alpha$ is 35-55°.

18. The projectile of claim 17 wherein angle $\alpha$ is 45°.

19. The projectile of claim 12 wherein the outer surface of the trailing section is smooth and includes no rifling grooves.

* * * * *